US006807999B1

(12) United States Patent
Bowen et al.

(10) Patent No.: US 6,807,999 B1
(45) Date of Patent: Oct. 26, 2004

(54) REMOVABLE AND RETRACTABLE PATHWAY VISUAL BARRIER

(75) Inventors: Walter Lee Bowen, Washington, NC (US); Cynthia L. Bowen, Washington, NC (US)

(73) Assignee: KidKusion, Inc., Washington, NC (US)

( * ) Notice: Subject to any disclaimer, the term of this patent is extended or adjusted under 35 U.S.C. 154(b) by 0 days.

(21) Appl. No.: 10/652,809

(22) Filed: Aug. 29, 2003

(51) Int. Cl.[7] ..... A47H 1/00
(52) U.S. Cl. ..... 160/24
(58) Field of Search ..... 160/24, 23.1, 29, 160/46, 66, 238, 313, 318; 256/1; 135/903

(56) References Cited

U.S. PATENT DOCUMENTS 1,526,126 A * 2/1925 Fitzherbert ..... 473/493
3,187,761 A * 6/1965 De Maio ..... 135/118
4,119,301 A * 10/1978 Payne ..... 256/41
4,595,155 A 6/1986 Gough
4,844,420 A * 7/1989 Oster ..... 256/1
4,993,719 A 2/1991 Hernandez
5,394,927 A * 3/1995 Huebner ..... 160/327
5,407,178 A * 4/1995 Long ..... 256/45
5,544,689 A * 8/1996 Wegner ..... 160/100
5,934,354 A * 8/1999 Price et al. ..... 160/370.22
6,089,302 A 7/2000 Britt
6,142,701 A * 11/2000 Falcon ..... 404/6
6,390,526 B1 5/2002 Ament et al.
6,733,204 B1 * 5/2004 Paniccia ..... 404/6

* cited by examiner

*Primary Examiner*—David Purol
(74) *Attorney, Agent, or Firm*—Coats & Bennett, P.L.L.C.

(57) ABSTRACT

A retractable barrier particularly adapted to providing a readily viewable boundary across a pathway so that a child may be discouraged from wandering outside the safe zone established thereby. A main post assembly rotatably supports a net carrier for rotation about an axis. A net of substantial height is secured on one end to the net carrier and has a secondary post secured to the other end. A spring is disposed between a cap and an upper flange. The spring secures to the cap and engages the net carrier assembly to supply a retraction bias to the net carrier. A first ground sleeve is inserted in the ground and adapted to releasably engage the lower post mount. A second ground sleeve is inserted in the ground and adapted to releasably engage the second post. The barrier is moveable between a retracted configuration and a deployed configuration.

11 Claims, 5 Drawing Sheets

REMOVABLE AND RETRACTABLE PATHWAY VISUAL BARRIER

FIELD OF THE INVENTION

The present invention is directed generally the field of child safety devices, and more particularly to an apparatus for setting a boundary across a pathway, such as a driveway, so as to discourage children from venturing across the boundary and/or to discourage vehicles from entering.

BACKGROUND OF THE INVENTION

It is well known that children are not always observant of safety risks. As such, an entire industry has developed that is dedicated to producing products that help protect children from injury. For example, Kidkusion, Inc. of Washington, N.C. produces a number of products that help shield children from the various sharp edges that exist indoors.

With respect to outdoor activities, one common problem is that children tend to wander away from play areas, even when specifically instructed not to. For instance, a parent may allow children to play on the portion of a driveway close to the house, but tell the children not to venture beyond a certain point on the driveway so as to keep them out of the street. However, once the children are playing, their attention to the relevant boundary markers is typically somewhat haphazard. One method of addressing this is to physically block the driveway with a large immovable object, such as a car. However, such objects themselves offer dangers, as they are typically fairly hard and unforgiving when fallen against. In addition, it may be inconvenient or otherwise undesirable to have to move a car just to establish a play zone. Likewise, it may be inconvenient or otherwise undesirable to have to move the car in order to allow unimpeded use of the pathway.

As such, there remains a need for child safety devices that allow for readily viewable boundaries across pathways to be established and removed.

SUMMARY OF THE INVENTION

The present invention provides a retractable barrier that is particularly adapted to providing a readily viewable boundary across a pathway, such as a driveway, so that a child may be discouraged from wandering outside, and/or to discourage vehicles from entering, the safe zone established thereby. The retractable barrier includes a main post assembly that rotatably supports a net carrier assembly for rotation about an axis. The main post assembly also includes an upper flange, a lower post mount, and a non-rotating cap. A net is secured on one end to the net carrier and has a secondary post is secured to the other end. A spring is disposed between the cap and the upper flange. A first end of the spring is secured to the cap and a second end of the spring engages the net carrier assembly. The spring supplies a retraction bias to the net carrier assembly. A first ground sleeve is inserted in the ground and adapted to releasably engage the lower post mount. A second ground sleeve is inserted in the ground and adapted to releasably engage the second post. The barrier is moveable between a retracted configuration and a deployed configuration. In the retracted configuration, the net is substantially wound onto the net carrier assembly. In the deployed configuration the lower post mount is inserted in the first ground sleeve, the axis is generally vertical, the second post is remote from the first post assembly and inserted in the second ground sleeve, and the net extends therebetween.

With the net of the barrier device stretched across the pathway, a child playing in the protected portion of the pathway, such as riding a tricycle on a portion of the driveway close to the house, will be confronted with the visual barrier if they try to venture farther down the driveway and out onto the street. However, when it is desired to remove the device so that the pathway may be used unimpeded, the secondary post is simply lifted up out of the ground sleeve and walked slowly back towards the post assembly. The retraction biasing force of the spring will cause the net carrier assembly to rotate and thereby rewind the net onto the net carrier assembly. The post assembly may then be removed from the ground, leaving only the grounding sleeves in place.

DETAILED DESCRIPTION OF THE INVENTION

The following description of a preferred embodiment of the present invention will be in the context of a conventional paved driveway 10 as an illustrative example of a relevant pathway to be blocked. However, it should be noted that the present invention may be used with a wide variety of pathways, and is not limited to use solely with conventional driveways. Indeed, the present invention may also be used to delineate boundaries of outdoor play areas such as wooded areas, severely sloped area of yards, and the like.

Figure 1:
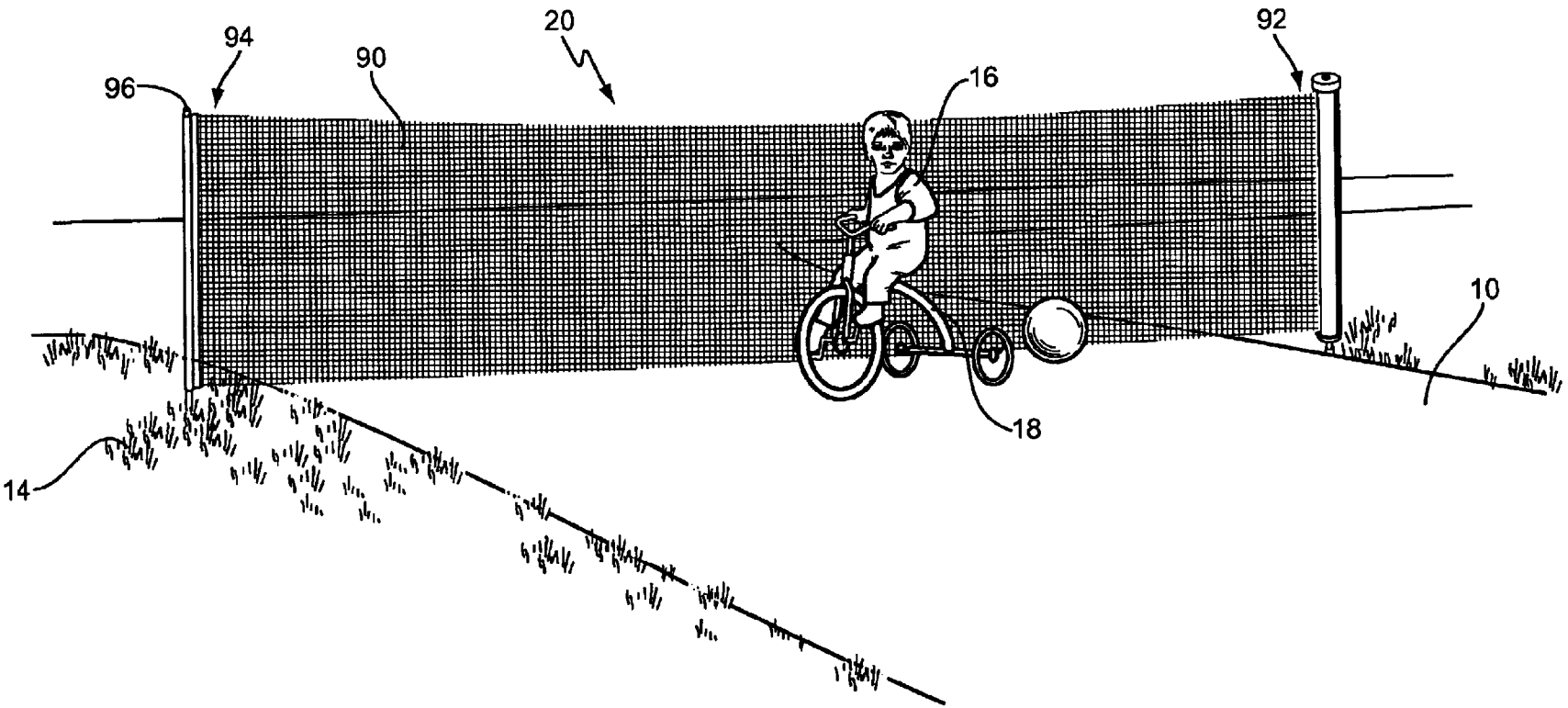
FIG. 1 is a perspective view of one embodiment of the retractable barrier deployed across a driveway in accordance with the present invention.
Figure 2:
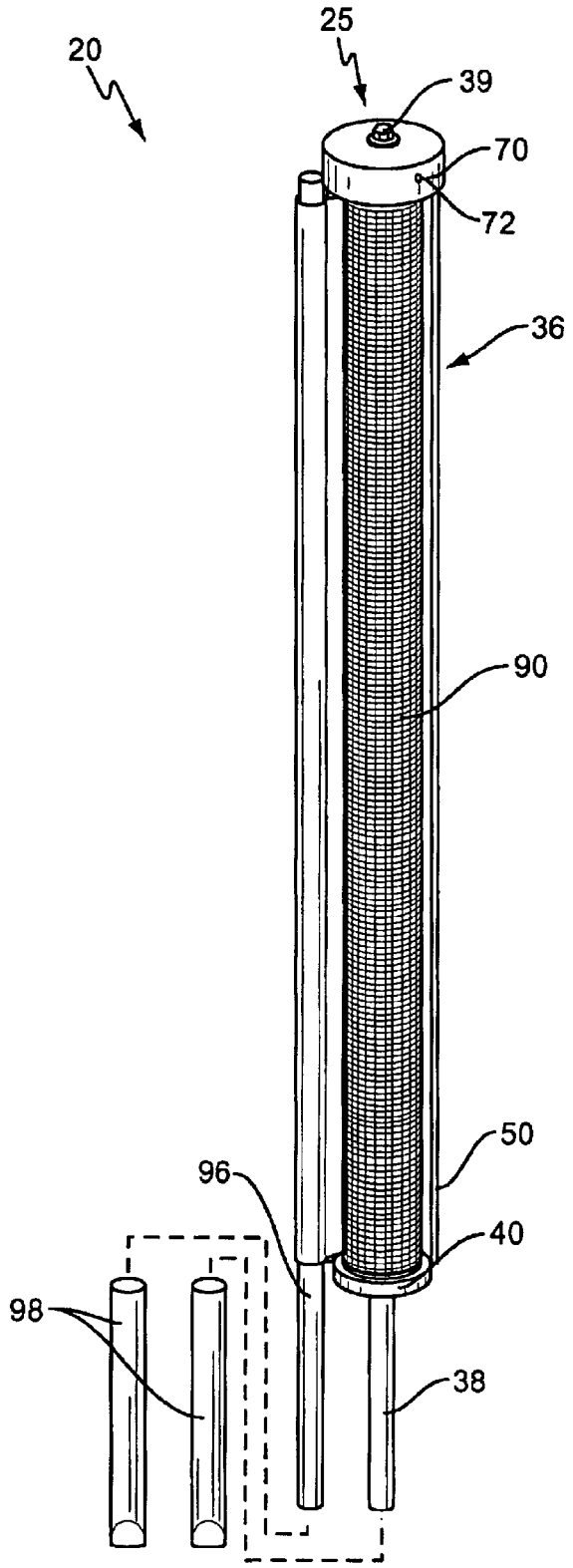
FIG. 2 is a partially exploded view of the retractable barrier of FIG. 1 with the net retracted.

As illustrated in FIG. 1, the barrier device of the present invention, generally indicated at 20, can be used to create a boundary across the driveway 10 so as to deter a child 16 from venturing out of the protected area. With the net 90 of the barrier device 20 stretched across the driveway 10, a child 16 playing in the protected portion of the driveway will be confronted with the visual barrier if they try to venture farther down the driveway 10 and out onto the street.

In a preferred embodiment, the barrier device 20 generally includes a main post assembly 25, a retractable net 90 of substantial height, and a pair of ground sleeves 98. The main post assembly 25 includes a center post assembly 30, a net carrier assembly 60, a cap 70, and a spring 80, as generally shown in FIGS. 2–5. The center post assembly 30 typically includes a center post 32, a lower flange 40, an upper flange 42, and a shroud 50. The center post 32 includes a main body 36, an upper end 34, and a lower end 38. The portions 34,36,38 of the center post 32 may be formed of separate elements that are joined together, or may be integrally formed; the latter arrangement is shown in the figures for simplicity. The main body 36 of the center post 32 extends between the upper and lower flanges 40,42 and provides the main support of the main post assembly 25. The upper end 34 of the center post 30 extends through a bore 44 in the upper flange 42 and advantageously includes a threaded end portion. The lower end of the center post 32 extends below the area associated with the net 90, through the lower flange 40, and forms the lower post mount 38. In addition, a generally curved shroud 50 extends partially around the center post assembly 30 (e.g., 90°–180°) and is mounted to the upper and lower flanges 40,42 so as to extend therebetween.

The net carrier assembly 60 is rotatably mounted on the center post assembly 30 for rotation about a central axis 28 that runs generally along center post 32. The net carrier assembly 60 typically takes the form of an elongate hollow tube. The lower portion of the net carrier assembly 60 is supported by the lower flange 40. The upper portion of the net carrier assembly 60 includes a shoulder 64 that rests against a corresponding shoulder 44 on the upper flange 42. In this manner, the net carrier assembly 60 is rotatably supported about the center post 32 between the upper and lower flanges 40,42. The upper portion of the net carrier assembly 60, referred to herein as the spindle 62, extends upward through the upper flange 42 and terminates short of the inside surface of cap 70. See FIG. 4. The spindle portion 62 of the net carrier assembly 60 is mounted to the main body of the net carrier assembly 60 such that rotational forces applied to the spindle 62 cause the main body of the net carrier assembly 60 to rotate. If desired, the spindle portion 62 of the net carrier assembly 60 may be integrally formed with the main body of the net carrier assembly 60. The spindle 62 advantageously includes a slit 66 for engaging the spring 80, as described further below. One end of the net 90 is attached to the outer surface of the net carrier assembly 60 so as to rotate therewith, as described further below.

Figure 5:
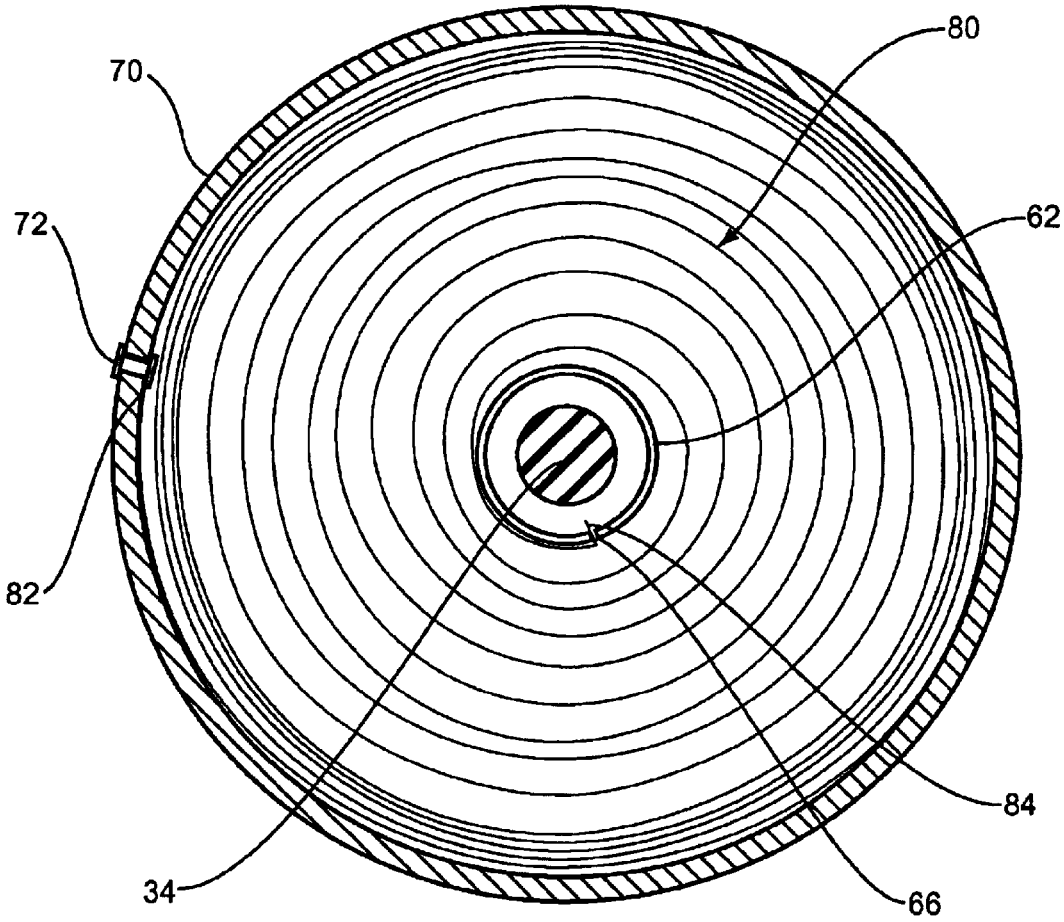
FIG. 5 is a top view of a portion the retractable barrier of FIG. 4 along line V—V with upper portion of the cap removed to shown the spring mounting thereof.

A cap 70 is disposed above the upper flange 42 and provides a cavity for holding the spring 80. The spring 80 includes one end 82 anchored to the cap 70, such as by riveting, and a second end 84 that engages the slit 66 in the spindle 62. See FIG. 5. The spring 80 is preferably of a type commonly referred to as a flat coil spring, and more preferably of a type commonly referred to as a constant tension flat coil spring. Thus, as shown in FIG. 5, the spring 80 is disposed about the spindle 62 of the net carrier assembly 60, with one end 82 fixed to the non-rotating cap 70, and the other end 84 engaging the rotating not carrier assembly 60. The threaded upper end 34 of the center post 32 extends up through the spindle 62 and through a corresponding hole (not labeled) in the cap 70. A nut with associated spring and flat washers (collectively 39) is secured to this threaded upper end 34 of a center post 32 and helps retain the center post 32 in the proper position. If desired, a washer 74 or other retainer may also be disposed about the center post 32 above the spring 80 so as to provide a bearing surface for the upper end of the net carrier assembly 60, and to help retain the spring 80 in proper position with respect to the spindle 62. The cap 70 is secured to the center post assembly 30 via the upper nut 39, and to the upper flange 42 via additional screws 52 that engage the upper flange 42, as may be desired.

As discussed above, the net 90 has a tethered end 92 secured to the net carrier assembly 60 and a free end 94 that is movable away from the main post assembly 25. The tethered end 92 of the net 90 may be attached to the net carrier assembly 60 via any known method. For instance, the net 90 may be secured to the net carrier assembly 60 by sewing the net 90 to a vinyl strip that is in turn adhesively secured to the outer surface of the main body of the net carrier assembly 60. The free end 94 of the net 90 has a secondary post 96 coupled thereto. The secondary post 96 may be permanently attached to the free end 94 of the net 90 in a manner similar to the affixation of the tethered end 92 to the net carrier assembly 60, or the secondary post 96 may simply slide through a loop formed in the free end 94 of the net 90, or other coupling approaches known in the art may be used. The net 90 is preferably of a somewhat open weave plastic net, and preferably of a readily visible color such as optic orange. Of course, other fabrics may be used, such as coated non-plastic nets, and/or other colors may be used, such as yellow, blue, green, etc. The weave of the net 90 should be relatively small, but need not be very fine; for instance, a knitted polyethylene net 90 with ⅛ inch by ⅛ inch mesh may be used. The net 90 should be long enough to stretch across the intended pathway, and be tall enough to provide a suitable visual barrier for a child. Thus, the lower edge of the net 90 should be very close to the ground forming the pathway 10, and the upper edge of the net should be substantially above this level, preferably to a height taller than that of a typical young child. The net 90 may advantageously be a length of at least fifteen feet and a height of at least two feet, and more advantageously three feet or more.

The ground sleeves 98 may take the form of simple elongate tubes that are open on their upper end and are flattened or otherwise sharpened at their lower end. It is intended that the lower end of these ground sleeves 98 be inserted into the ground on opposing sides of the driveway. The upper ends of the ground sleeves are open and sized to accept the corresponding lower post mount 38 of the main post assembly 25 or the secondary post 96. Preferably the lower post mount 38 and the secondary post 96 are of the same outer diameter and length, so that the ground sleeves 98 may be interchangeable.

The barrier device 20 may be assembled by coupling the tethered end 92 of the net 90 to the net carrier assembly 60 and winding the net 90 thereon. The lower flange 40 is secured to the center post 32, for instance by inserting a pin (not shown) through the lower flange 40 and the center post 32. With the lower flange 40 secured to the center post 32, the net carrier assembly 60 is slid over the center post 32 and down onto the lower flange 40. The upper flange 42 is then added by feeding the spindle 62 through the hole in the upper flange 42 such that the respective shoulder portions 64,44 engage each other. The shroud 50 is joined to the lower and upper flanges 40,42 via screws 52. The cap 70, with the spring 80 anchored on one end 82 thereof is fitted over the upper end 34 of the center post 32 and slid downward such that the spindle end 84 of the spring 80 engages the slit 66 in the spindle 62 and the center post 32 extends through the retaining washer 74. The cap 70 is then turned a number of turns to pre-load the spring 80, and secured to the upper flange 42 by additional screws and cap nut 39. The secondary post 96 is then added to the free end of the net 90. The main post assembly 25 and the ground sleeves 98 are then packaged with suitable instructions. At this point the barrier device 20 ready for deployment in the field.

Figure 3:
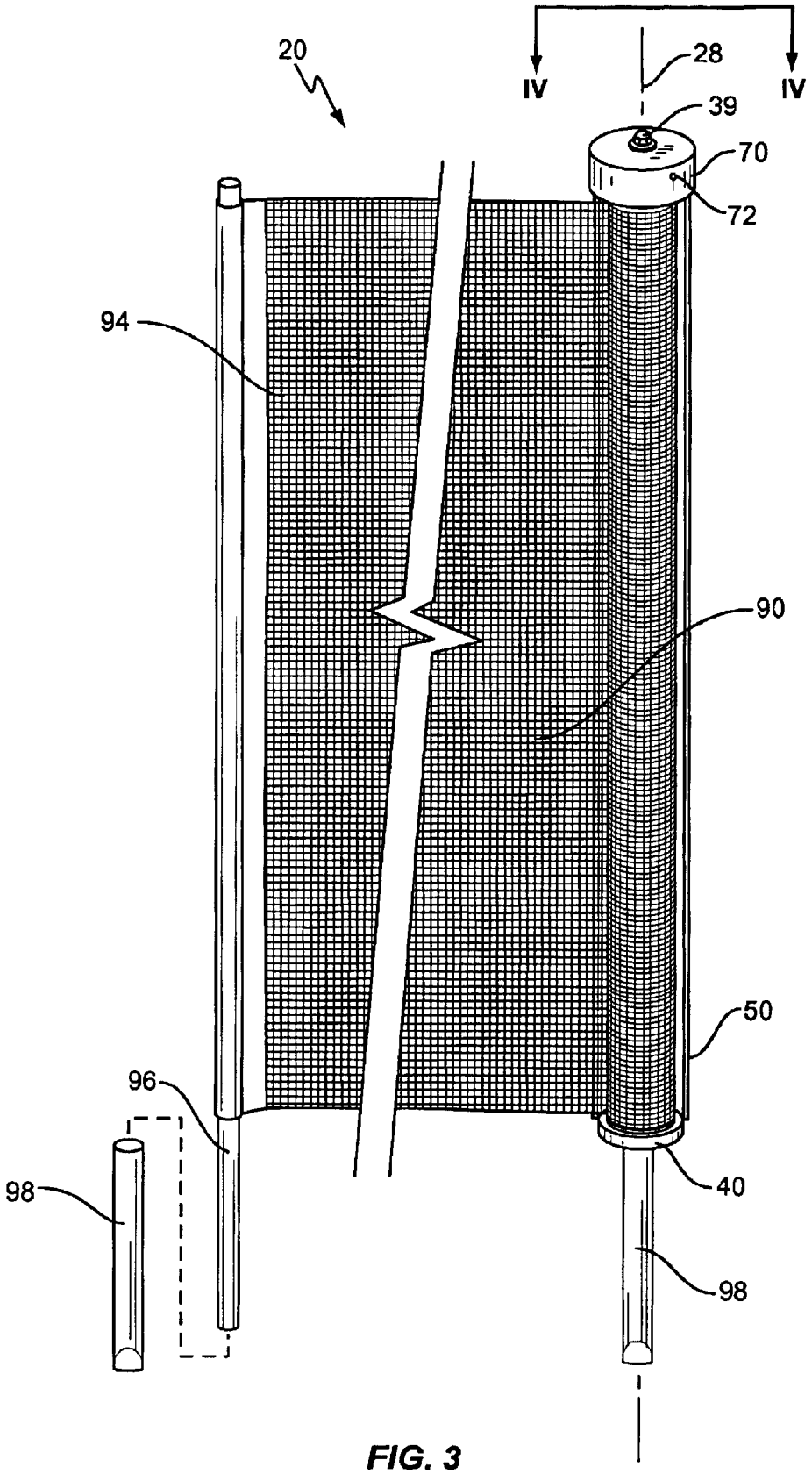
FIG. 3 is a partially exploded view of the retractable barrier of FIG. 1 with the net deployed.
Figure 4:
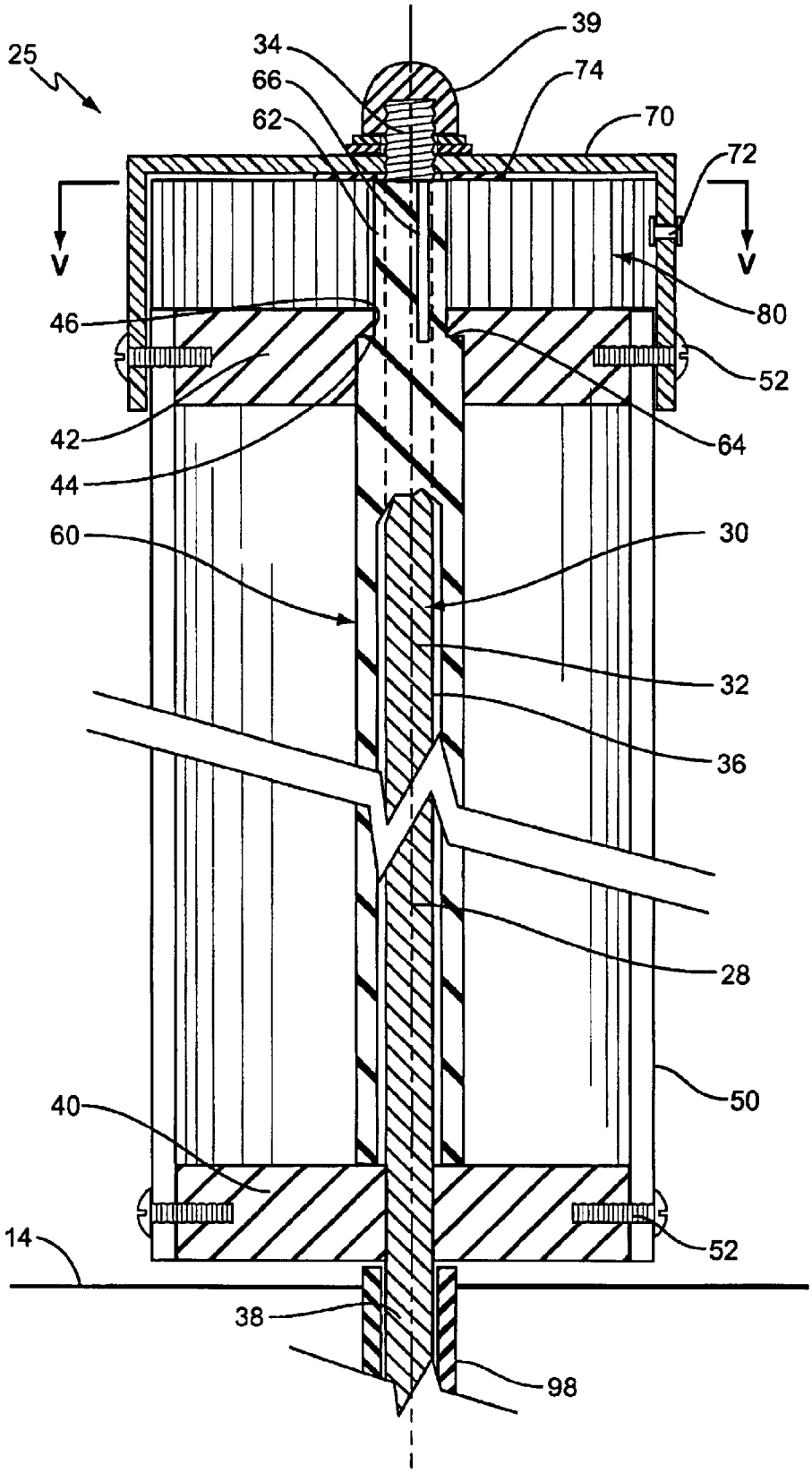
FIG. 4 is a sectional view of a portion of the retractable barrier of FIG. 3 along line IV—IV with the net removed for clarity.

In the field, the device 20 may be used to establish a boundary of a safe zone of a pathway, for instance a driveway, as follows. The ground sleeves 98 are driven vertically into the ground 14 on either side of the driveway 10. The main post assembly 25 is then inserted into the ground sleeve 98 on one side of the driveway 10 such that axis 28 is generally vertical. At this point, the device 20 is still in its retracted position. That is, the net 90 is wound about the net carrier assembly 60 due to the retraction bias force of the spring 80, such that the secondary post 96 is located proximate the main post assembly 25. The secondary post 96 is then pulled across the driveway 10 and inserted into the ground sleeve 98 on that side. At this point, the barrier device 20 is in its deployed position with the secondary post 96 located remote from the main post assembly 25, and the net 90 extending therebetween (FIG. 3). The lower edge of the net 90 is in close proximity to the driveway 10, and the net extend generally vertically upward at least a couple of feet to a height taller than that of a typical young child. With the net 90 of the barrier device 20 stretched across the driveway 10, from the grass 14 on one side to the grass 14 on the other side, a child 16 playing in the protected portion of the driveway, such as riding a tricycle 18 therein, will be confronted with the visual barrier of the net 90 if they try to venture farther down the driveway 10 and out onto the street. Thus, the barrier device 20 of the present invention provides a visual barrier across a pathway 10 in the deployed position.

When it is desired to remove the barrier device 20 so that the driveway 10 may be used unimpeded, the secondary post 96 is simply lifted up out of its ground sleeve 98 and walked slowly back towards the main post assembly 25. The retraction biasing force of the spring 80 will cause the net carrier assembly 60 to rotate and thereby rewind the net 90 onto the net carrier assembly 60 between the flanges 40,42 and inside the shroud 50. The main post assembly 25 may then be removed from the ground, leaving only the grounding sleeves 98 in place.

While not pointed out above, it may be advantageous for the upper flange 42 to include a peripheral recess (not shown) corresponding to the shroud 50 so that the upper end of the shroud 50 and upper flange 42 may fit inside the cap 70 for a more aesthetic appearance. In addition the various portions of the barrier device 20 may be integrally formed or assembled together as may be efficient from a cost perspective, provided that the net carrier assembly 60 is rotationally supported and biased toward retraction, and the main post assembly 25 and the secondary post 96 are releasably engaged by the ground sleeves 98.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A retractable barrier for visually blocking a pathway, comprising:

a first post assembly having a net carrier assembly, an upper flange, a lower post mount, and a non-rotating cap, said net carrier rotatably supported to rotate about an axis;

a net secured on one end to said net carrier and having a second post coupled to another end;

a spring disposed between said cap and said upper flange, said spring anchored to said cap and supplying a retraction bias to said net carrier assembly;

a first ground sleeve for insertion in the ground and adapted to releasably engage said lower post mount;

a second ground sleeve for insertion in the ground and adapted to releasably engage said second post;

wherein said barrier is moveable between a retracted configuration where said net is substantially wound onto said net carrier assembly and a deployed configuration where said lower post mount is inserted in said first ground sleeve;

said axis is generally vertical;

said second post is remote from said first post assembly and inserted in said second ground sleeve; and said net extends therebetween.

2. The barrier of claim 1 wherein said first post assembly further comprises a center post around which said net carrier assembly rotates, said center post secured to said cap.

3. The barrier of claim 1 wherein said first post assembly further comprises a lower flange below said net and a generally curved shroud extending between said upper flange and said lower flange.

4. The barrier of claim 1 wherein said spring is a flat coil spring.

5. The barrier of claim 4 wherein said spring is a constant force flat coil spring.

6. The barrier of claim 1 wherein said net carrier includes a slit on an upper end thereof, and wherein said spring engages said slit.

7. The barrier of claim 1 wherein said post assembly further comprises a lower flange, said net carrier assembly disposed between said upper and lower flanges and extending through said upper flange.

8. The barrier of claim 1 wherein said net is orange.

9. The barrier of claim 1 wherein said net extends generally vertically upward from proximate the ground to a height of at least two feet in said deployed configuration.

10. The barrier of claim 1 wherein said first and second ground sleeves have pointed lower ends.

11. A retractable barrier for visually blocking a pathway, comprising:

a first post assembly having a net carrier assembly, an upper flange, a lower post mount, and a non-rotating cap, a center post around which said net carrier assembly rotates, said center post secured to said cap, said net carrier rotatably supported to rotate about an axis;

a net secured on one end to said net carrier and having a second post coupled to another end;

wherein said first post assembly further comprises a lower flange below said net and a generally curved shroud extending between said upper flange and said lower flange, and wherein said net carrier assembly is disposed between said upper and lower flanges and extends through said upper flange;

a flat coil spring disposed between said cap and said upper flange, said spring having a first end anchored to said cap and a second end engaging said net carrier assembly, said spring supplying a retraction bias to said net carrier assembly;

wherein said net carrier includes a split on an upper end thereof, and wherein said spring engages said slit;

a first ground sleeve for insertion in the ground and adapted to releasably engage said lower post mount;

a second ground sleeve for insertion in the ground and adapted to releasably engage said second post;

wherein said barrier is moveable between a retracted configuration where said net is substantially wound onto said net carrier assembly and a deployed configuration where said lower post mount is inserted in said first ground sleeve;

said axis is generally vertical;

said second post is remote from said first post assembly and inserted in said second ground sleeve; and said net extends therebetween; and wherein said net extends generally vertically upward from proximate the ground to a height of at least two feet in said deployed configuration.

* * * * *